US007381060B2

(12) United States Patent
Ju

(10) Patent No.: US 7,381,060 B2
(45) Date of Patent: Jun. 3, 2008

(54) ELECTRICAL CONNECTOR ARRAY

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/439,974

(22) Filed: May 25, 2006

(65) Prior Publication Data

US 2007/0275573 A1 Nov. 29, 2007

(51) Int. Cl.
*H01R 12/00* (2006.01)

(52) U.S. Cl. ..... 439/66; 439/67

(58) Field of Classification Search ..... 439/67, 439/66

See application file for complete search history.

(56) References Cited

U.S. PATENT DOCUMENTS 5,199,889 A * 4/1993 McDevitt, Jr. ..... 439/66
5,305,547 A * 4/1994 Weiss ..... 439/395
5,366,380 A * 11/1994 Reymond ..... 439/66
5,800,184 A * 9/1998 Lopergolo et al. ..... 439/66
5,902,138 A * 5/1999 Murakami ..... 439/76.2
6,022,224 A * 2/2000 Peters ..... 439/66
6,077,089 A * 6/2000 Bishop et al. ..... 439/66
6,099,356 A * 8/2000 Hwang ..... 439/660
6,193,523 B1 * 2/2001 Harper, Jr. ..... 439/66
6,193,524 B1 * 2/2001 Chang ..... 439/66
6,217,396 B1 * 4/2001 Hwang et al. ..... 439/862
6,290,507 B1 * 9/2001 Neidich et al. ..... 439/66
6,394,816 B1 * 5/2002 Watanabe ..... 439/67
6,438,831 B1 * 8/2002 Hagihara ..... 29/884
6,604,950 B2 * 8/2003 Maldonado et al. ..... 439/66
6,733,303 B2 * 5/2004 Maldonado et al. ..... 439/66
6,758,702 B2 * 7/2004 Johnescu ..... 439/862
6,843,659 B2 * 1/2005 Liao et al. ..... 439/66
6,905,343 B1 * 6/2005 Neidich ..... 439/66
6,929,483 B2 * 8/2005 Huang et al. ..... 439/66
7,074,048 B2 * 7/2006 Liao et al. ..... 439/66

* cited by examiner

*Primary Examiner*—Chandrika Prasad
*Assistant Examiner*—Harshad C Patel
(74) *Attorney, Agent, or Firm*—Rosenberg, Klein & Lee

(57) ABSTRACT

An electrical connector and a method for manufacturing the same are disclosed. The method comprises the following steps: 1) inserting a wire into a groove formed in a guiding member; 2) passing the wire along with the guiding member through an elastomer; 3) removing the guiding member; and 4) bending the wire to abut against the elastomer to form an elastic contact therebetween. The electrical connector comprises an elastomer; and wires provided in the elastomer, wherein each wire is bent to abut against the elastomer.

10 Claims, 6 Drawing Sheets

ELECTRICAL CONNECTOR ARRAY

BACKGROUND OF THE INVENTION

1. Field of the Invention

The present invention relates to an electrical connector and a method for manufacturing the same.

2. Description of the Related Art

Referring to FIGS. 8 to 11, a conventional method for manufacturing an electrical connector, comprises the following steps: 1) stacking wire sets 8 layer by layer, and 2) slicing the stacked layers of wire sets 8 into several desired electrical connectors. In the method, the wire set 8 comprises an upper film 81, a lower film 82, and wires 83 formed between the two films. However, the method has the following disadvantages: it is a complicated process, has a high cost, a low processing efficiency due to the first step of stacking.

Therefore, in view of the above drawbacks of the prior art, the inventor proposes the present invention to overcome the above problems based on his deliberate researches and related principles.

SUMMARY OF THE INVENTION

The object of the present invention is to provide a simple and economic method for manufacturing an electrical connector.

Another object of the present invention is to provide a simple and economic electrical connector.

According to one aspect of the present invention, the method for manufacturing an electrical connector, comprises the following steps: 1) inserting a wire into a groove formed in a guiding member; 2) passing the wire along with the guiding member through an elastomer; 3) removing the guiding member; and 4) bending the wire to abut against the elastomer to form an elastic contact therebetween.

According to another aspect of the present invention, the electrical connector comprises an elastomer and wires provided in the elastomer, which is characterized in that each wire is bent to abut against the elastomer.

Compared with the prior art, the present invention provides a simple and economic electrical connector and a method for manufacturing such an electrical connector.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The characteristics and the technical contents of the present invention will be further understood in view of the detailed description and accompanying drawings. However, it should be noted that the drawings are illustrative and are not to be used to limit the scope of the present invention. Wherein.

DETAILED DESCRIPTION OF THE PREFERRED EMBODIMENTS

Figure 1:
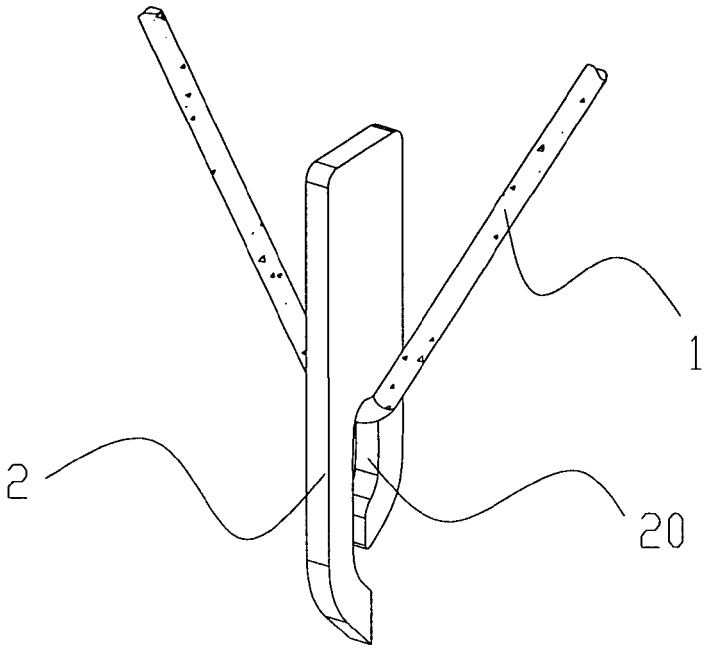
FIG. 1 is a perspective view showing a wire inserted into a groove formed in a guiding member according to a method for manufacturing an electrical connector of the present invention.
Figure 2:
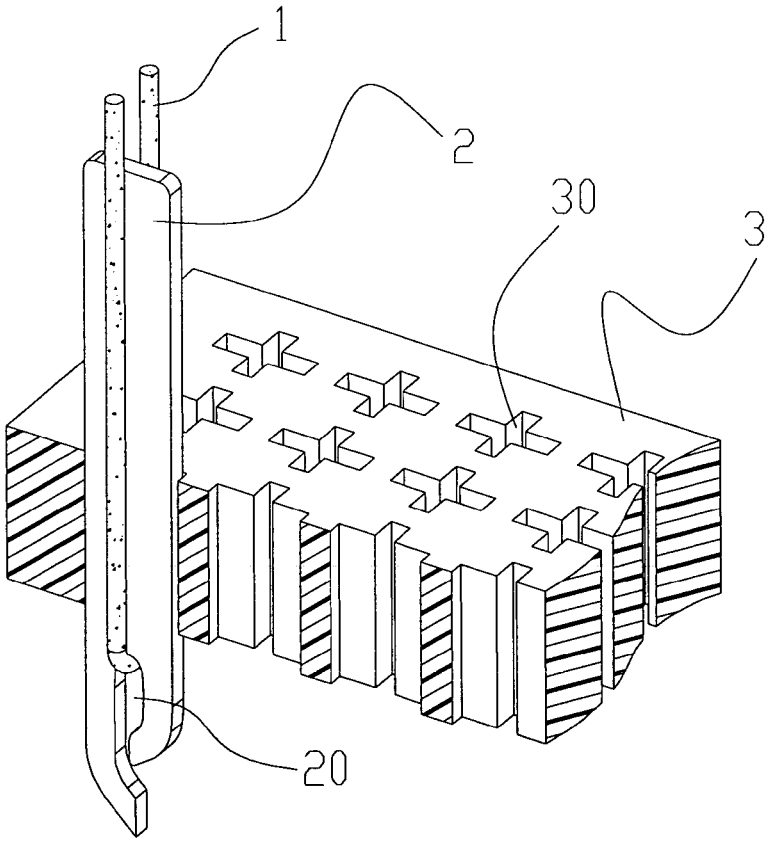
FIG. 2 is a perspective view showing the guiding member and the wire shown in FIG. 1 accommodated in a hole.
Figure 3:
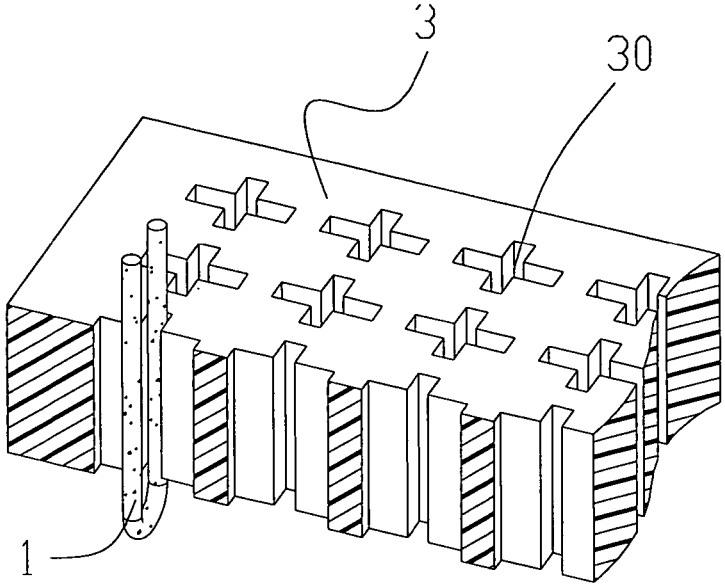
FIG. 3 is a perspective view showing the guiding member shown FIG. 2 removed.
Figure 4:
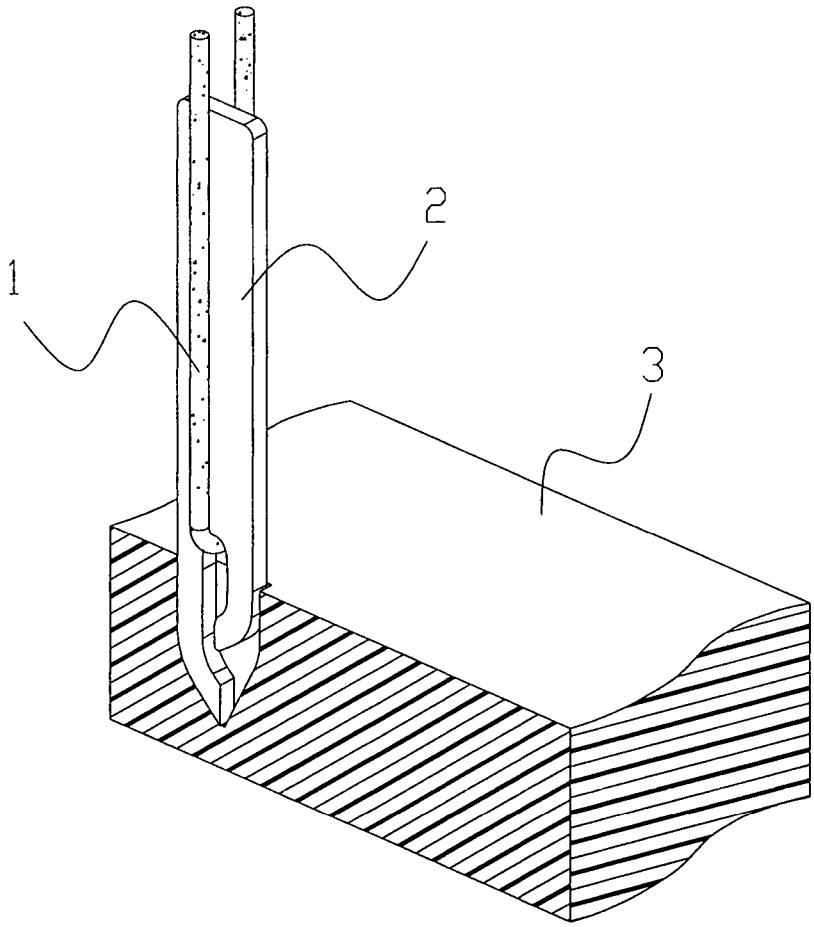
FIG. 4 is a perspective view showing a guiding member penetrating an elastomer according to an alternative method of the present invention.
Figure 5:
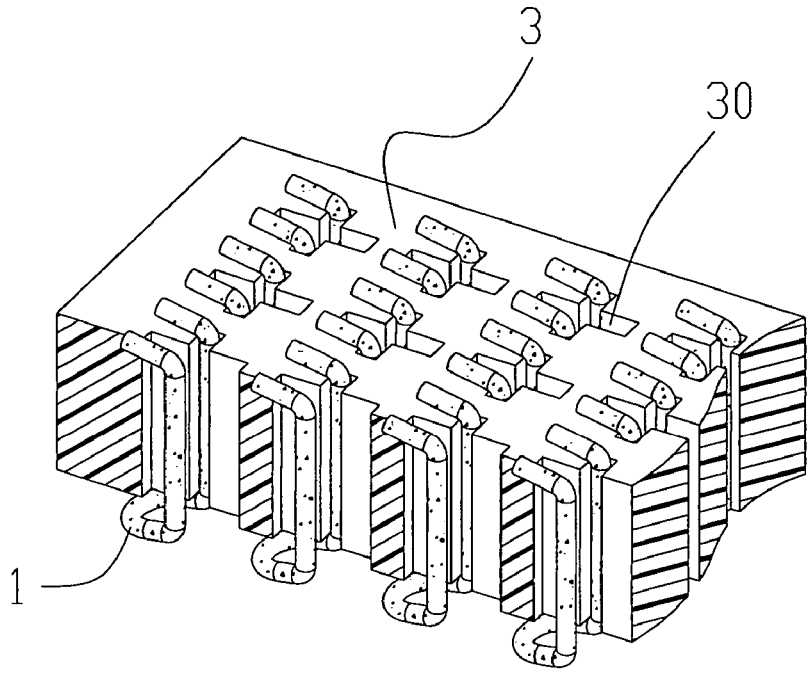
FIG. 5 is a perspective view showing both ends of each wire bent according to the present invention.

Referring to FIGS. 1 to 5, according to the present invention, the method for manufacturing an electrical connector, comprises the following steps: 1) inserting a wire 1 into a groove 20 formed in a guiding member 2; 2) passing the wire 1 along with the guiding member 2 through an elastomer 3. In this embodiment, the elastomer 3 is provided with a first hole 30 allowing the guiding member 2 to pass therethrough. Alternatively, as shown in FIG. 4, the guiding member 2 may be employed to penetrate the elastomer 3, thereby passing the wire 1 through the elastomer 3. The method further comprises the following steps: 3) removing the guiding member 2 to leave the wire 1 in the first hole 30 formed in the elastomer 3 alone; and 4) bending both ends of the wire 1 to abut against the a top and a bottom surface of the elastomer 3 to form an elastic contact therebetween. Each of the wires 1 of the electrical connector manufactured by the method is in elastic contact with a corresponding electronic component due to compression of the elastomer 3 between the wire and the electronic component. In this embodiment, the electronic component is substantially a chip module.

Figure 6:
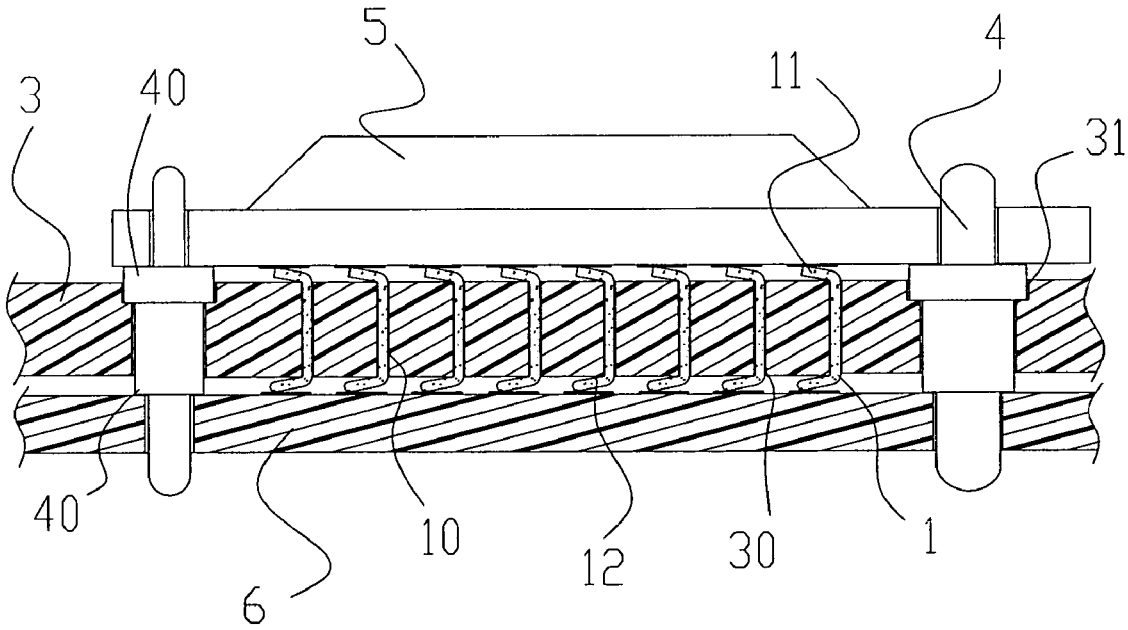
FIG. 6 is a side view showing the electrical connector in combination with a corresponding electronic component according to the present invention.

Referring to FIG. 6, according to the present invention, the electrical connector comprises: an elastomer 3, wires 1 provided in the elastomer 3, and at least two positioning structures 4 for mating with a corresponding electronic component. In this connector, the elastomer 3 is provided with holes 30 for accommodating the wires 1. Alternatively, the wires can directly penetrate the elastomer and are then arranged in the elastomer. Each wire 1 in the elastomer 3 is bent and comprises a stationary portion 10, and a upper and a lower contact portion both bent at a top and a bottom end of the stationary portion 10 respectively. The lower contact portion 12 is in contact with the corresponding circuit board 6. Additionally, each corner of the elastomer 3 is provided with a second hole 31 for positioning the positioning structure 4 with the elastomer 3. The positioning structure 4 is also provided with a plug 40 for limiting a height of the corresponding electronic component. Alternatively, the plug 40 can be provided on the electrical connector, instead of the positioning structure, to keep the connector from being damaged due to excessive forces being applied to the corresponding electronic component. When connected with the two corresponding electronic components, the positioning structure 4 is fixed with the two components and provides electrical connection therebetween.

Figure 7:
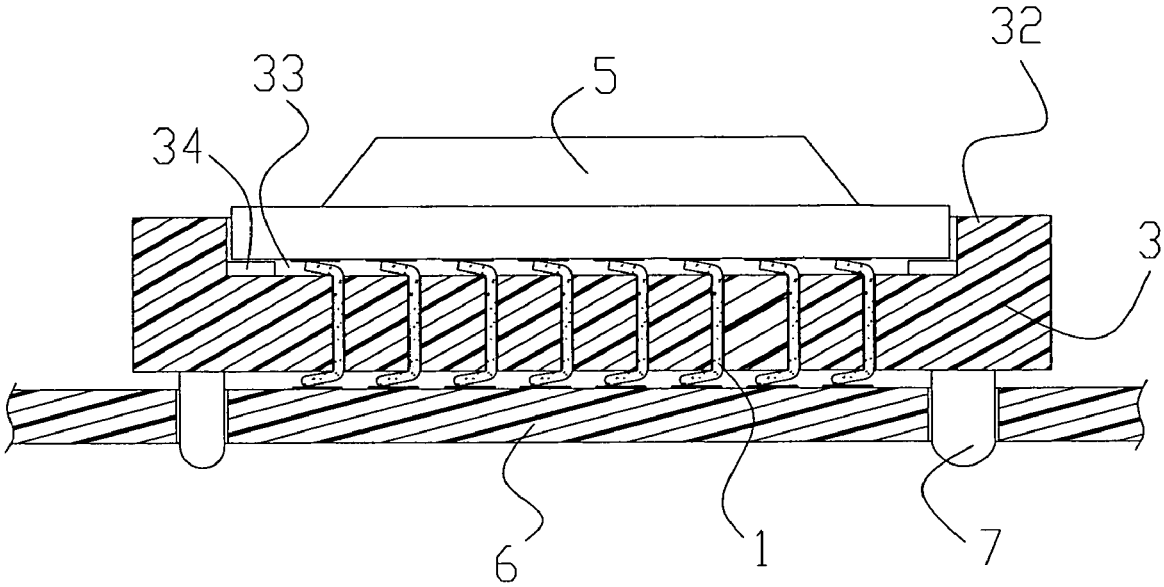
FIG. 7 is a side view showing the electrical connector in combination with a corresponding electronic component according to another embodiment of the present invention.
Figure 8:
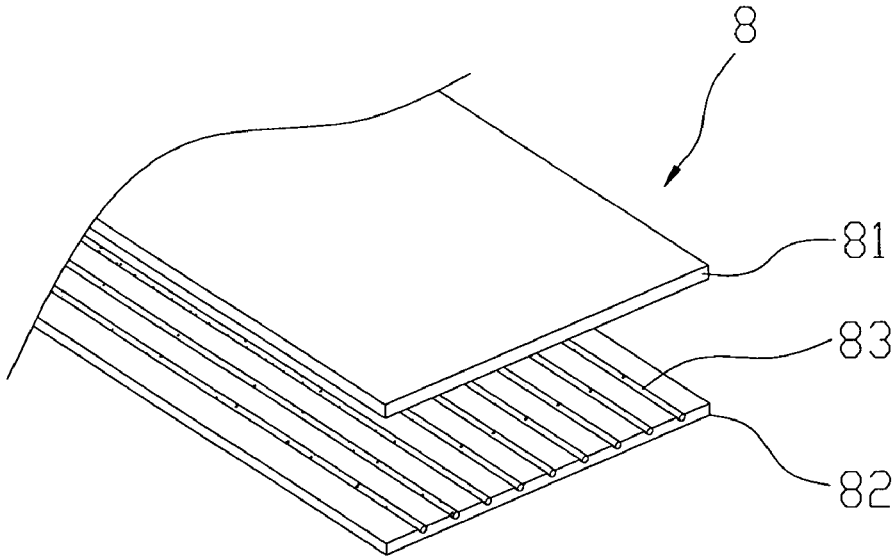
FIG 8 PRIOR ART
FIG. 8 is a perspective view showing a wire set for an electrical connector in prior art.
Figure 9:
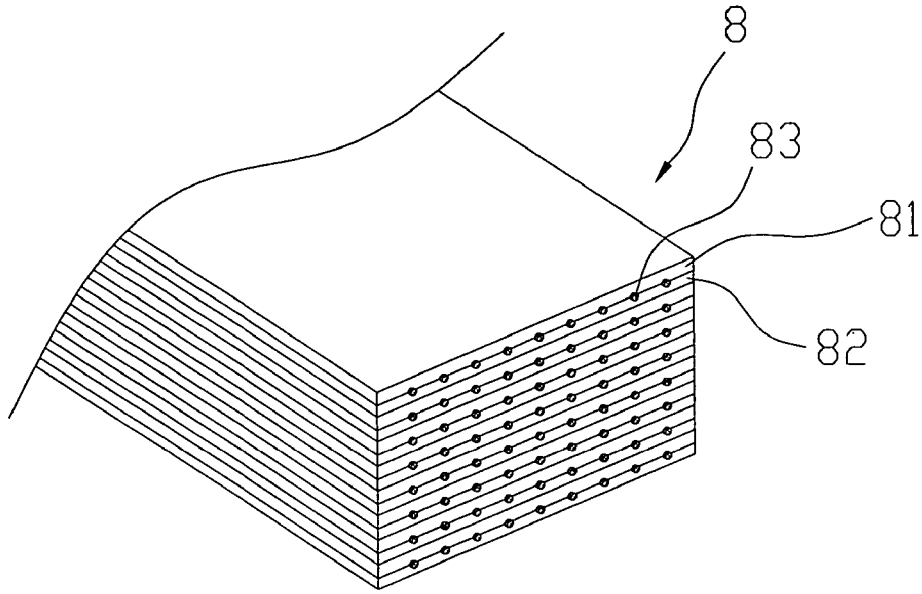
FIG 9 PRIOR ART
FIG. 9 is a perspective view showing several layers of wire sets stacked together in prior art.
Figure 10:
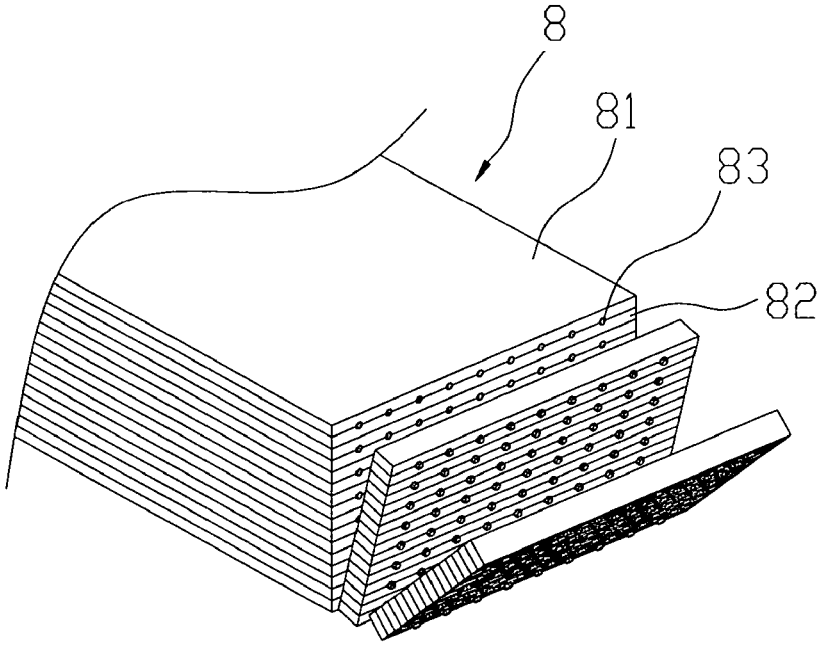
FIG 10 PRIOR ART
FIG. 10 is an operational perspective view showing the wire sets shown in FIG. 9 having been sliced.
Figure 11:
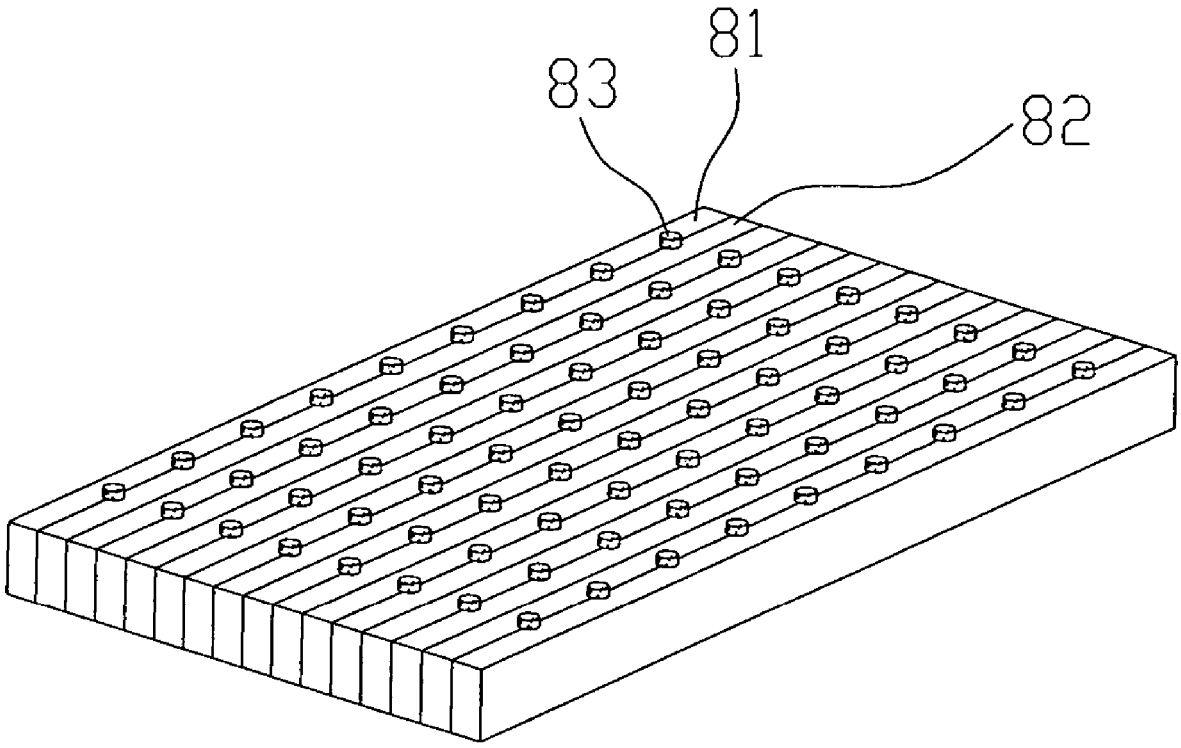
FIG 11 PRIOR ART
FIG. 11 is a perspective view showing a conventional electrical connector in prior art.

Referring to FIG. 7, another embodiment different from the first one is disclosed. A peripheral of one side of the elastomer 3 is provided with a positioning element 32 for positioning a corresponding electronic component. A space 33 enclosed by the positioning element 32 is formed to accommodate a chip module, and spacers 34 are provided in the space 33 to prevent the chip module 5 experiencing excessive forces. Meanwhile, the other side of the elastomer is provided with posts 7 matching with and holding the circuit board 6. Thus, the chip module is electrical ally connected with the circuit board with the aid of the wires.

The electrical connector made by passing the wires into the elastomer, has the following merits: it has a simple configuration, the process is easy, it is cheap and has a higher processing efficiency.

Although the present invention has been described with reference to the foregoing preferred embodiment, it will be understood that the invention is not limited to the details thereof. Various equivalent variations and modifications may occur to those skilled in this art in view of the teachings of the present invention. Thus, all such variations and equivalent modifications are also embraced within the scope of the invention as defined in the appended claims.

What is claimed is:

1. An electrical connector array comprising:

an insulative elastomer substrate; and a plurality of wires bent at a position located between two free ends thereof to form a curved portion and set in a plurality of holes formed in said insulative elastomer substrate, said wires including a first contacting portion formed by said curved portion and a second contacting portion formed by said two free ends thereof, both said contacting portions contacting with said insulative elastomer substrate elastically, and two sides of said curved portion being located in the same hole.

2. The electrical connector array as claimed in claim 1, wherein the wire penetrates the elastomer.

3. The electrical connector array as claimed in claim 1, wherein the elastomer is provided with holes allowing the wires to pass therethrough.

4. The electrical connector array as claimed in claim 1, wherein the electrical connector array is provided with spacers.

5. The electrical connector array as claimed in claim 1, wherein an electronic component is provided with at least two positioning structures.

6. The electrical connector array as claimed in claim 5, wherein the positioning structure is provided with plugs.

7. The electrical connector array as claimed, in claim 1, wherein a peripheral side of the elastomer is provided with a positioning element for positioning a corresponding electronic component, and another side of the elastomer is provided with posts matching the corresponding electronic component.

8. The electrical connector array as claimed in claim 1, wherein the wire is passed along with a guiding member through the elastomer.

9. The electrical connector array as claimed in claim 1, wherein the second contacting portion of each wire includes a plurality of electric contacts connected with each other through a connection portion formed at the first contacting portion.

10. The electrical connector array as claimed in claim 9, wherein the connection portion is disposed to abut a circuit board.

* * * * *